US007334507B2

(12) United States Patent
Wu

(10) Patent No.: US 7,334,507 B2
(45) Date of Patent: Feb. 26, 2008

(54) TEETHLESS ADJUSTABLE SPANNER

(75) Inventor: Arthur Wu, Taichung Hsien (TW)

(73) Assignee: Proxene Tools Co., Ltd., She Kou Village, Shen Kang Hsiang, Taichung (TW)

( * ) Notice: Subject to any disclaimer, the term of this patent is extended or adjusted under 35 U.S.C. 154(b) by 0 days.

(21) Appl. No.: 11/406,126

(22) Filed: Apr. 19, 2006

(65) Prior Publication Data

US 2007/0245860 A1 Oct. 25, 2007

(51) Int. Cl.
*B25B 13/12* (2006.01)

(52) U.S. Cl. ..... 81/129; 81/128; 81/176; 81/176.15

(58) Field of Classification Search ..... 81/128, 81/129, 176, 176.15
See application file for complete search history.

(56) References Cited

U.S. PATENT DOCUMENTS 4,833,949 A * 5/1989 Piperkovski ..... 81/127

6,205,892 B1 * 3/2001 Davidson ..... 81/128

* cited by examiner

*Primary Examiner*—Joseph J. Hail, III
*Assistant Examiner*—Shantese McDonald

(57) ABSTRACT

A toothless adjustable spanner includes a handle, a head at one end of the handle; a fixing jaw extending from the head; the head being formed with a sliding groove and a receiving groove in the head and communicated to the sliding groove; a sliding rod being received in the sliding groove and installed below a movable jaw; the movable jaw being installed in the sliding groove; the sliding rod has an inclined lower surface; at least one rolling rod being installed in the receiving groove; an elastic unit resisting against rolling rod toward the movable jaw so that the rolling rod resists against the inclined lower side of the sliding rod; at least one driving sheet installed at one outer side of an opening of the receiving groove; and the sliding rod being installed to the driving sheets so that the sliding rod moves as the driving sheets move.

12 Claims, 9 Drawing Sheets

TEETHLESS ADJUSTABLE SPANNER

FIELD OF THE INVENTION

The present invention relates to spanners, and in particular to a toothless adjustable spanner, wherein no teeth is used and the movable jaw can be firmly secured.

BACKGROUND OF THE INVENTION

In one prior art about the adjustable spanner, U.S. Pat. No. 2,948,175, the adjustable spanner has a transversal slot for receiving a sliding rod. A head of the adjustable spanner is installed with a wedge groove communicated to the slot for receiving a spring and a wedge block. The wedge block resists against a release rod in a receiving groove of the movable jaw. Thereby when the user press the release rod, the wedge block is pushed to move toward the fixing jaw so as to press the spring. Thus, the wedge block will separate from the sliding rod at the lower end of the movable jaw. The opening between the movable jaw and the fixing jaw is adjustable.

Furthermore, in another prior art, U.S. Pat. No. 6,848,342, a toothless adjustable spanner is disclosed. In the adjustable spanner, a spring resisting against the movable jaw and adjustable spanner is installed in the sliding groove. A receiving groove communicated to the sliding rod is installed in the head. The receiving groove is installed with a sparing and a rolling ball and a release rod a part of which exposes out. A receiving groove has an inclined surface at a direction facing the fixing jaw. Thus, when the release rod is released, the rolling ball will move into the inclined surface so that a buckling unit releases from the limitation of the movable jaw. Therefore, the size of the opening between the movable jaw and the fixing jaw is adjustable.

However the above two prior arts has the following disadvantages.

The use of the adjustable spanner is inconvenient. In the two prior arts, release rods are installed. By pressing the release rod, the wedge block or rolling ball will release and the spring fixed in the sliding groove will push the movable jaw away. However in application, a greater force is necessary to press the distal end of the movable jaw (the pressing force is greater than the elastic coefficient) so that it is installed in use. If a spring with lower elasticity is used, the spring is easily bent. As a result the lifetime of the spanner is reduced.

Furthermore, the wedge block has two sliding grooves which are engaged to two ribs of the spanner. If a greater force is applied. The two will be engaged to one another and thus it is difficult to release them.

If is difficult to communicate the wedge slot to the sliding groove. The wedge block and the ribs are difficult to manufacture. Furthermore, if a cover is used, it is difficult in machine-work and thus the cost is high.

SUMMARY OF THE INVENTION

Accordingly, the primary object of the present invention is to provide a toothless adjustable spanner, wherein no teeth is used and the movable jaw can be firmly secured.

To achieve above objects, the present invention provides a toothless adjustable spanner which comprises a handle, a head at one end of the handle; a fixing jaw extending from the head; the head being formed with a sliding groove and a receiving groove in the head and communicated to the sliding groove; a sliding rod being received in the sliding groove and installed below a movable jaw; the movable jaw being installed in the sliding groove; the sliding rod has an inclined lower surface; at least one rolling rod being installed in the receiving groove; an elastic unit resisting against rolling rod toward the movable jaw so that the rolling rod resists against the inclined lower side of the sliding rod; at least one driving sheet installed at one outer side of an opening of the receiving groove; the sliding rod being installed to the driving sheets so that the sliding rod moves as the driving sheets move.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
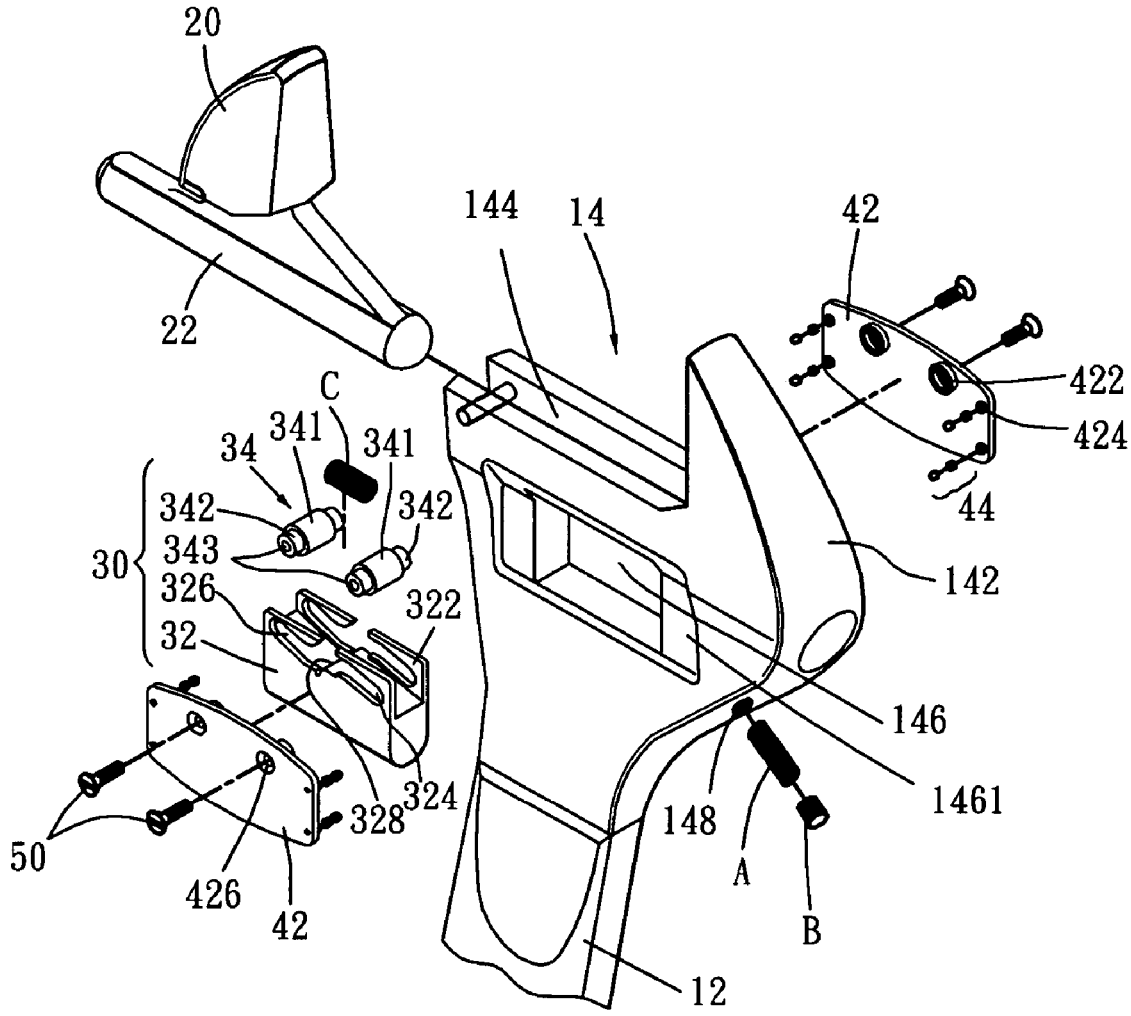
FIG. 1 is an exploded schematic view of the toothless adjustable spanner of the present invention.
Figure 2:
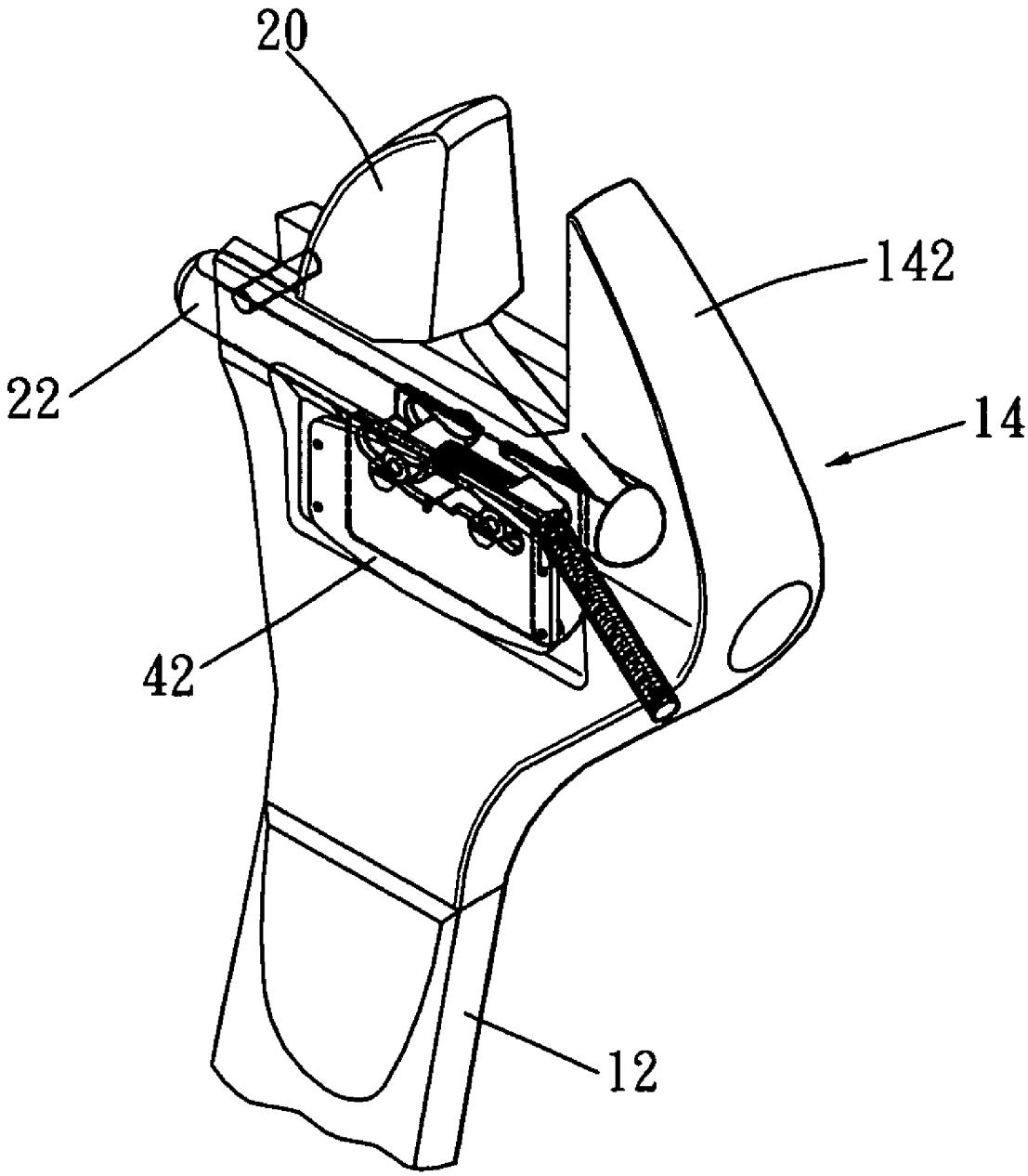
FIG. 2 is a partial perspective view of the toothless adjustable spanner of the present invention.

Referring to FIGS. 1 and 2, the spanner of the present invention is illustrated. The present invention has the following elements.

A body (only the main portion is illustrated) has a handle 12. One end of the handle 12 is extended with a head 14. One end of the head 14 is extended with a fixing jaw 142. The head 14 has a sliding slot 144 which penetrates into the fixing jaw 142. The head 14 has a receiving groove 146 communicated to the sliding slot 144. Two outer sides of the receiving groove 146 are formed with resisting surfaces 1461 around an opening of the receiving groove 146. Furthermore, the head 14 has an inclined spring hole 148 which is communicated to the receiving groove 146. The spring hole 148 receives a first spring A and a plug B for sealing the spring A.

Figure 9:
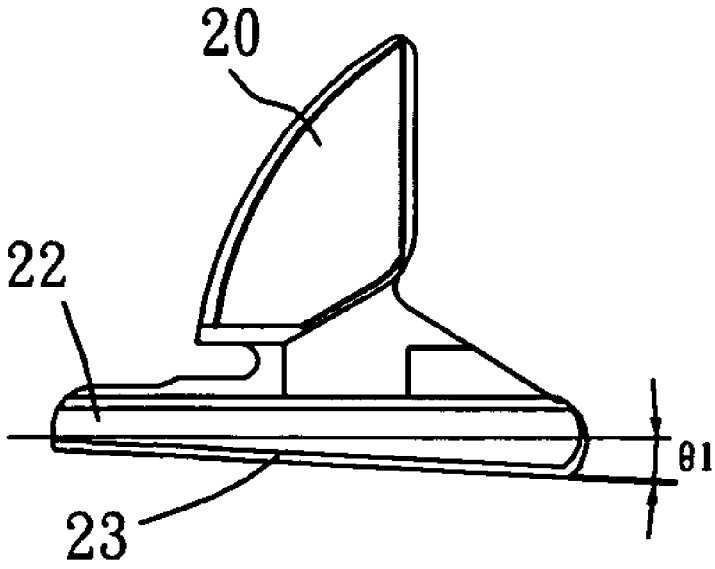
FIG. 9 is a structural schematic view about the movable jaw of the present invention.
Figure 10:
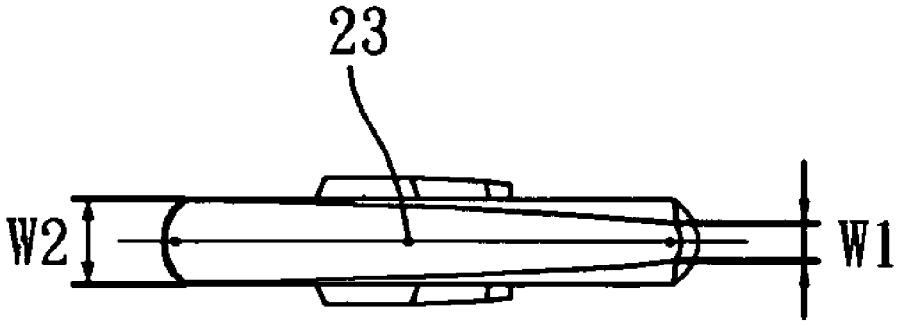
FIG. 10 is schematic view showing the inclined surface of the movable jaw of the present invention.

A movable jaw 20 is retained in the sliding slot 144, as shown in FIGS. 9 and 10. A sliding rod 22 is installed with the sliding slot 144. The sliding rod 22 has a round cylinder shape. An upper side of the sliding rod 22 is chamfered and an inclined sheet 23 extended from an upper side of the sliding rod 22. One side W1 of the inclined sheet 23 near the fixing jaw 142 is narrower than the side W2 of the inclined sheet 23 far away from the fixing jaw 142. A lower side of the sliding rod 22 is inclined with an inclined angle between 0.5 to 10 degrees.

A buckling unit 30 has a receiving block 32 and two rolling rods 34. The buckling unit 30 is placed in the receiving groove 146.

The receiving block 32 is a long block having a shape corresponding to that of the receiving groove 146 of the head 14. A lower end of the receiving block 32 is a round cambered side for contacting the receiving groove 146, the rolling posts 34, and the inclined sheet 23. Each of two upper sides of the receiving block 32 is extended with two wings 322 which are symmetrically and a slot (a first slot 324 near the fixing jaw 142 and a second slot 326 near the movable jaw 20) is formed between the two wings 322. Each wing has a notch. The lower side of the notch is an inclined surface with an inclined angle of 0.5 to 15 degrees. A stop 328 is formed at the connection of the first slot 324 and the second slot 326.

Two stepped rolling rods 34 are inserted into the notches of he wing so as to be placed in the first slot 324 and the second slot 326. Each rolling rod 34 has a rod body 341 and two shafts 342 extending from two ends of the rod body 341. A size of the shaft 342 is smaller than that of the rod body 341. Each shaft 342 has a threaded hole 343. The shaft 342 in the first slot 324 resists against the spring A in the spring hole 148 of the head 14. A second spring C is installed between the two rolling rods 34. The sliding rod 22 is placed above the two rolling rods 34.

A driving unit includes two driving sheets 42. Each driving sheet 42 has two penetrating holes 422 for receiving the shafts 342. Each of four corners of each driving sheet 42 has a through hole 424. Each through hole 424 is received with a resisting unit 44. The resisting unit 44 includes a spring and a steel ball (or a hollow nut). An outer side of each penetrating hole 422 is formed with threads 426 for receiving a screw 50. The screw 50 is further screwed into the threaded hole 343. Thereby the driving sheets 42 is connected to the two rolling rods 34 so as to adjust the driving sheets 42 will drive the rolling rods 34 to move. In assembly, the driving sheet 42 resists on the resisting surface 1461.

Figure 3:
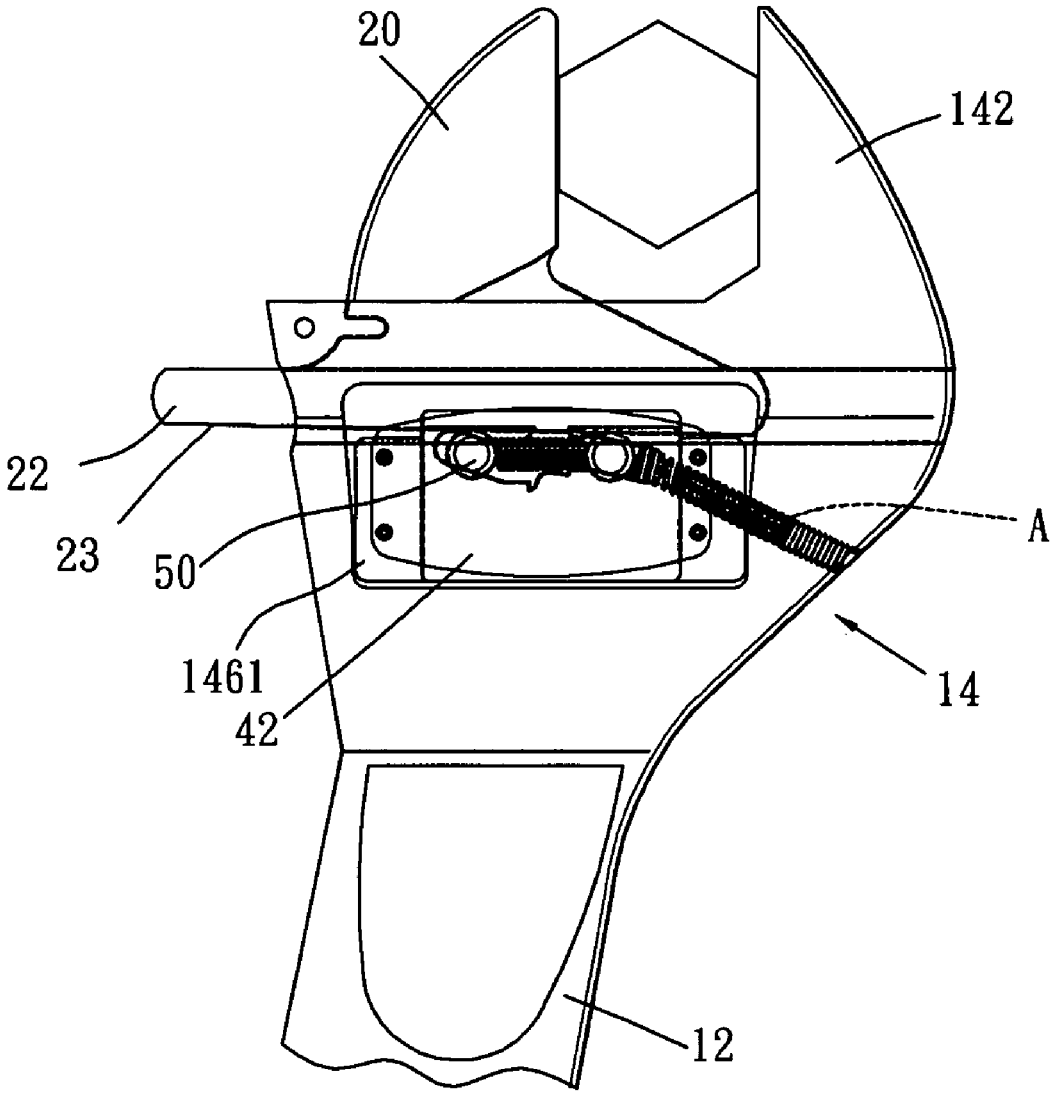
FIG. 3 is a schematic view about the adjustment of an opening of the toothless adjustable spanner of the present invention.
Figure 4:
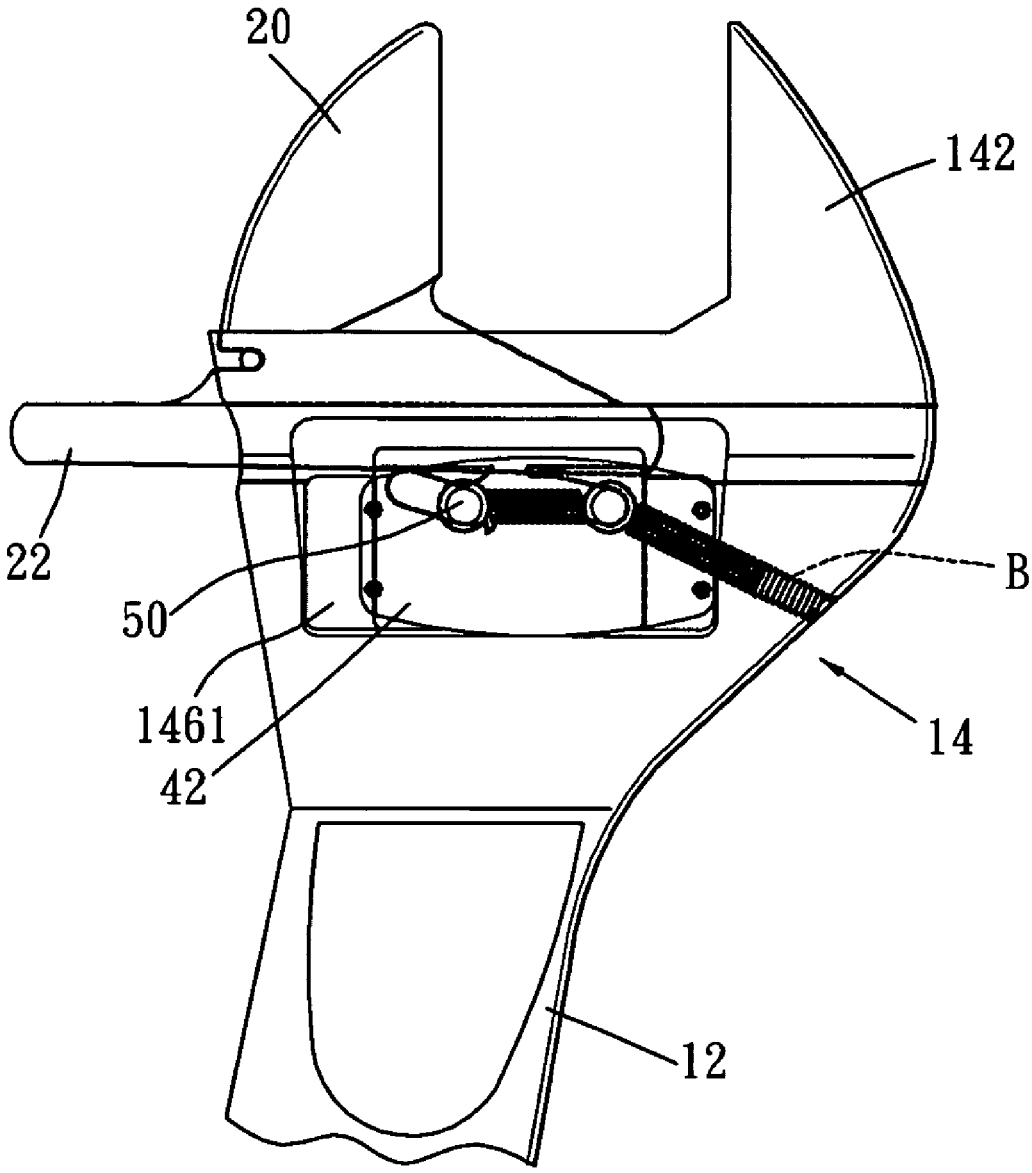
FIG. 4 is a schematic view about the adjustment of the opening of the toothless adjustable spanner according to the present invention.

Referring to FIGS. 3 and 4, the function of the present invention will be described herein.

Referring to FIG. 3, the rolling rods 34 resisting against the first and second springs A, B resist against a lower side of the sliding rod 22 of the movable jaw 20 so as to prevent the movable jaw 20 to fall out or vibrate. Moreover the opening between the movable jaw 20 and fixing jaw 142 can retain a driven object firmly.

If it is desired to adjust the size of the opening between the two jaws, it is only necessary to move the driving sheets 42 toward the fixing jaw 142. The driving sheets 42 will drive the two rolling rods 34. The two rolling rods 34 will compress the first and second springs A, C and thus to fall into the recessed portion between the two slots. The rolling rod 34 in the second slot will resist against the stop 328. Another rolling rod 34 is confined by the first slot. The two rolling rods 34 can release from the movable jaw 20 for adjusting the opening between the two jaws. It is only necessary to push a protruding end of the movable jaw 20 to a desired position to cause the rolling rods 34 to return to the position in FIG. 3. Thus, the opening of the adjustable spanner can be adjusted silently and rapidly. It is not limited by teeth. Thereby the driven means can be clamped firmly.

The resisting units 44 make the two driving sheets 42 being not adhered upon the resisting surfaces 1461 (a distance is retained therebetween). Thus, the movement of the driving sheet 42 is smooth and successful.

Figure 5:
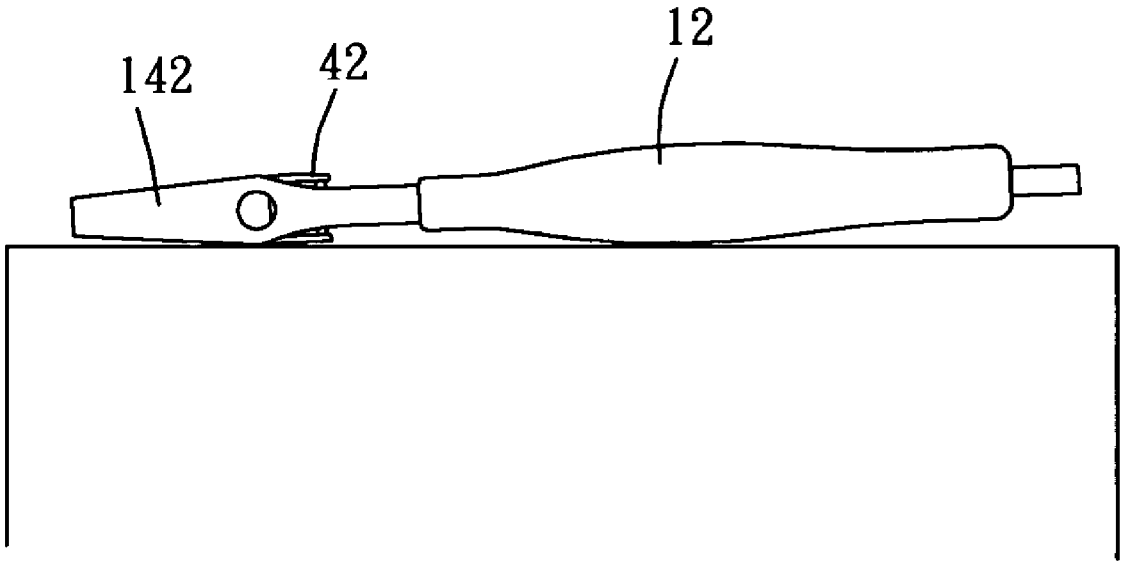
FIG. 5 is a schematic view showing the toothless adjustable spanner being placed flatly.

Moreover, referring to FIG. 5, in the present invention, the driving sheet 42 resists against the resisting surface 1461 so that the outermost of the driving sheet 42 is lower than the head and handle. Thus, in the operation, the driving sheet 42 will not contact the environment. Thereby in operation, the rolling rods 34 will not separate from the movable jaw 20.

Figure 6:
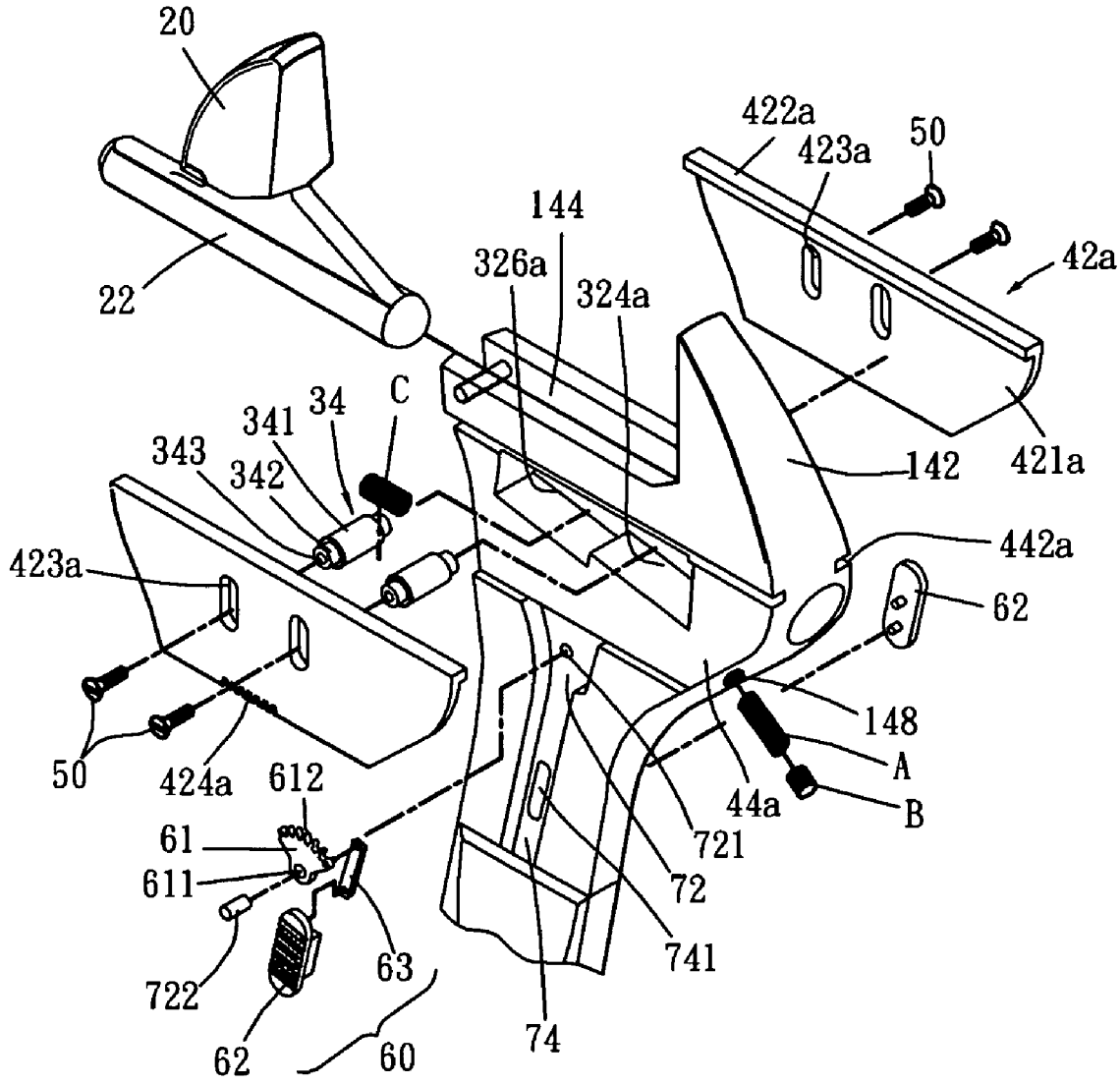
FIG. 6 is an exploded schematic view about the second embodiment of the present invention.
Figure 7:
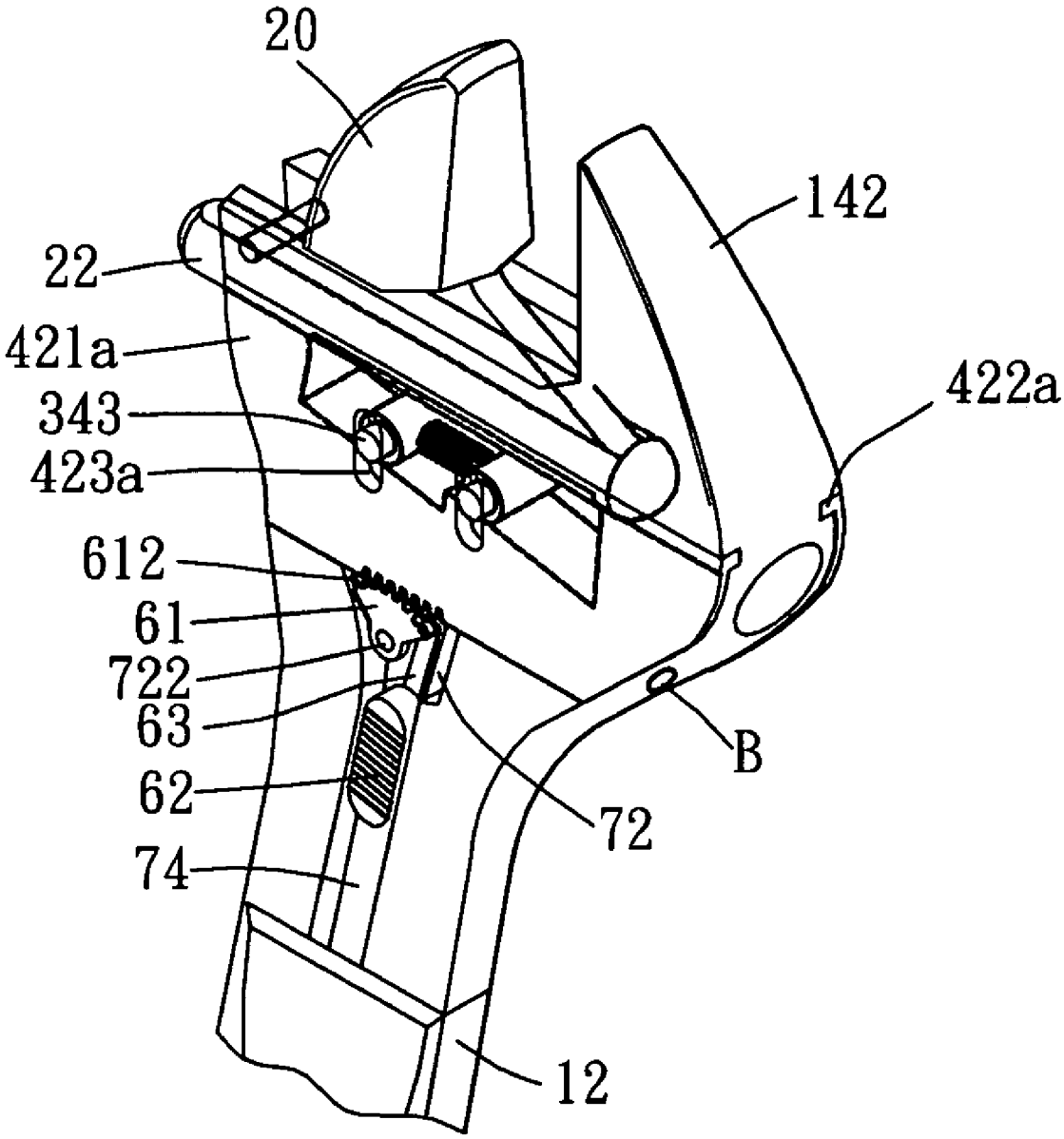
FIG. 7 is a perspective view about the second embodiment of the present invention.
Figure 8:
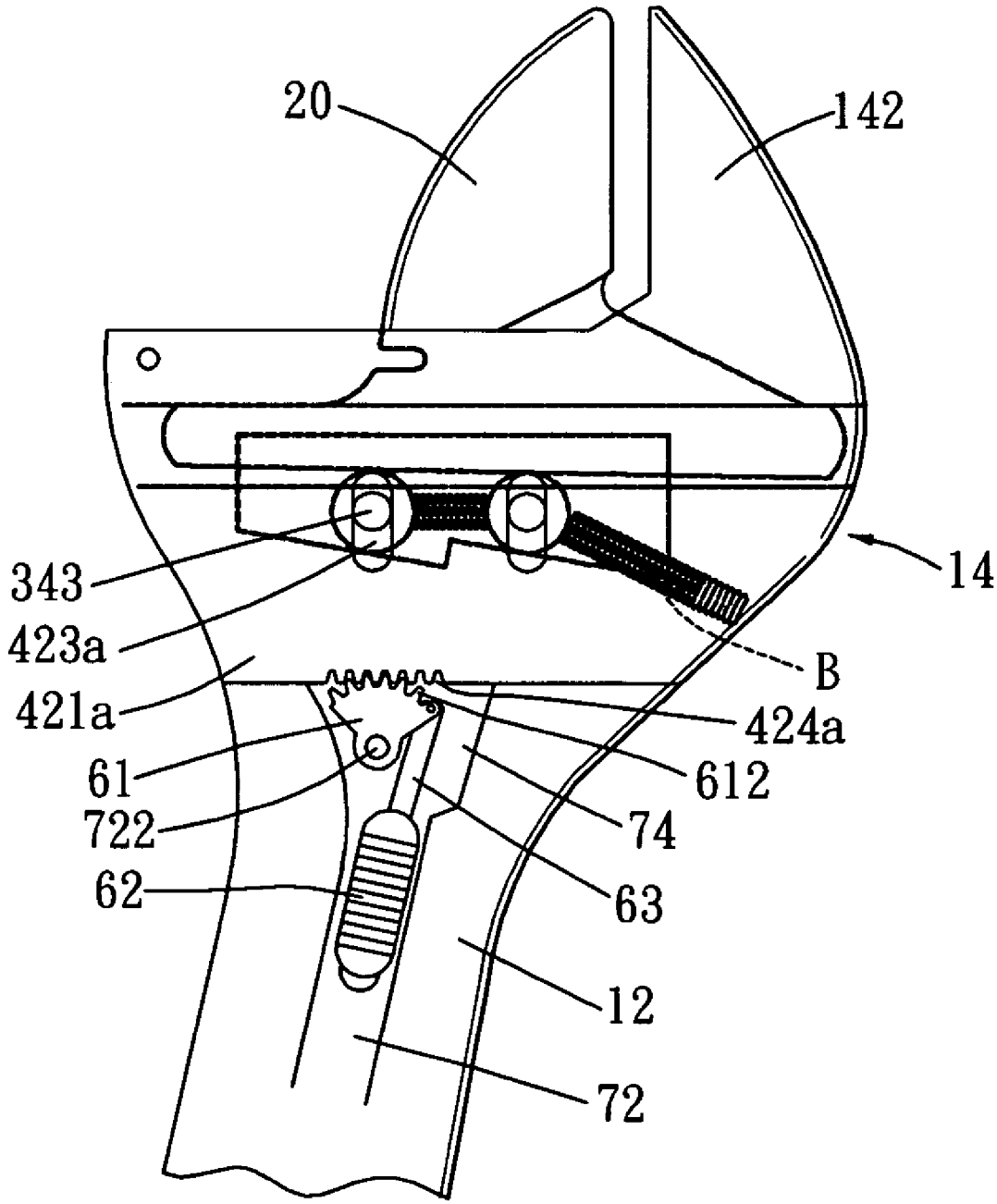
FIG. 8 is a schematic view showing the use of the second embodiment of the present invention.

Referring to FIGS. 6 to 8, the second embodiment of the present invention will be described herein. Those identical to the first embodiment will not be described. Only the difference from the first embodiment will be described herein.

The receiving groove is formed with a first slot **324*a* and a second slot 326*a***.

The driving unit has two driving sheets **42*a*. Each of the head 14 is formed with a narrow surface 44*a* around an opening of the receiving groove. A top end of each narrow surface 44*a* has a guide trench 442*a***.

Two driving sheets **42*a* are adhered upon the narrow surface 44*a*. A top end of each driving sheet 42*a* has a projection 422*a* which is slidably received in the guide trench 442*a*. Each driving sheet 42*a* has two elliptical holes 423*a* fore receiving two rolling rods 34. Thereby when moving any of the driving sheet 42*a*, the rolling rods 34** will move.

A lower side of each driving sheet **42*a* has a teeth portion 424*a***.

A control device 60 is installed to the teeth portion **424*a* for driving the driving sheet 42*a*. The control device 60 has sector teethed sheet 61. The sector teethed sheet 61 has an axial hole 611. An edge of the sector teethed sheet 61 has teeth 612 which is engageable to the teeth portion 424*a* of the driving sheet 42*a*. The control device 60 has two push sheets 62. A linkage 63 serves to connect the push sheets 62 and the sector teethed sheet 61**.

A handle 12 is formed with a first recess 72 and a second recess 74 communicated to the first recess 72. The first recess 72 serves for receiving the sector teethed sheet 61 by using a pin 722 to pass through the axial hole 611 of the sector teethed sheet 61 and a via hole 721 of the first recess 72.

The second recess 74 is a long hole 741. The two push sheets 62 are engaged at two sides of the long hole 741. The two push sheets 62 are movable along the long hole 741.

The use of the second embodiment will be described herein. When a thumb presses the control device 60, the rolling rods 34 will separate from the receiving groove. Then the movable jaw 20 moves to make the opening between the two jaws having a maximum size (since the input end of the sliding slot 144 has a pin which will stop the movable jaw so that the movable jaw will not fall out). Then the thumb presses the protruding end of the sliding rod. The movable jaw will be confined. Thereby the rolling rods and movable jaw are confined. The driven object can be driven.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A toothless adjustable spanner comprising:

a handle, a head at one end of the handle; a fixing jaw extending from the head; the head being formed with a sliding groove and a receiving groove in the head and communicated to the sliding groove;

a sliding rod being received in the sliding groove and installed below a movable jaw; the movable jaw being installed in the sliding groove; the movable jaw having an inclined lower surface;

two rolling rods installed in the receiving groove; an elastic unit resisting against the two rolling rods and the rolling rod resists against the inclined lower side of the movable jaw; wherein the elastic unit includes a first spring received in an inclined spring hole in the head; and a second spring being installed between the two rolling rods;

at least one driving sheet installed at one outer side of an opening of the receiving groove; the sliding rod being installed to the driving sheet so that the sliding rod moves as the driving sheets move;

wherein when the driving sheet is driven to move, the sliding rod will compress the first and second springs so that the the movable jaw is released; thus, a size of a space between the movable jaw and fixing jaw is adjustable.

2. The toothless adjustable spanner as claimed in claim 1, wherein the receiving groove is formed at the head; and a lower side of the receiving groove is formed with two continuous inclined surfaces; and a surface of each inclined surface faces toward the fixing jaw 142.

3. The toothless adjustable spanner as claimed in claim 2, wherein the inclined angle of each inclined surface is between 0.5 degree to 15 degrees.

4. The toothless adjustable spanner as claimed in claim 1, wherein a receiving block is received in the receiving groove; and a lower side of the receiving block is formed with two continuous inclined surfaces; and a surface of each inclined surface faces toward the fixing jaw.

5. The toothless adjustable spanner as claimed in claim 4, wherein the inclined angle of each inclined surface is between 0.5 degree to 15 degrees.

6. The toothless adjustable spanner as claimed in claim 4, wherein a lower end of the receiving block is a round cambered side.

7. The toothless adjustable spanner as claimed in claim 1, wherein the lower side of the sliding rod has an inclined angle of 0.5degree to 15 degrees.

8. The toothless adjustable spanner as claimed in claim 1, wherein the handle has a recess and a control device is installed in the recess for driving the driving sheet.

9. The toothless adjustable spanner as claimed in claim 8, wherein the control device includes a sector teethed sheet for engaging a teeth portion at a lower side of the driving sheet; at least one push sheet movable along a long hole in the handle; and a linkage for connecting the push sheet and the sector teethed sheet.

10. The toothless adjustable spanner as claimed in claim 1, wherein a periphery of the opening of the receiving groove is formed with a guide trench for slidably installing the driving sheet; the driving sheet having at least one elliptical hole for receiving a shaft 342 at one side of the rolling rod.

11. The toothless adjustable spanner as claimed in claim 1, wherein the driving sheet 42 has two penetrating holes for receiving the shafts; each of four corners of each driving sheet has a through hole; each through hole is received with a resisting unit; an outer side of each penetrating hole is formed with threads for receiving a screw; the screw is further screwed into the threaded hole; thereby the driving sheets is connected to the rolling rod so as to adjust the driving sheets to drive the rolling rods to move.

12. The toothless adjustable spanner as claimed in claim 1, wherein the inclined surface at a lower side of the sliding rod has a narrow side near the fixing jaw and a wide side far away from the fixing jaw.

* * * * *